US006192823B1

(12) United States Patent
Tsumiyama et al.

(10) Patent No.: US 6,192,823 B1
(45) Date of Patent: Feb. 27, 2001

(54) PERSONAL WATERCRAFT

(75) Inventors: Yoshinori Tsumiyama, Miki; Kenichi Nakagawa, Kobe; Tomohiro Kanazawa, Amagasaki, all of (JP); Kiyoaki Maeda; Kunihiko Kamio, both of Irvine, CA (US); Joe Heim, Orange, CA (US); William Peter Engle, Jr., Mesa, CA (US); Gary Bozych, Lake Forest, CA (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/482,485

(22) Filed: Jan. 12, 2000

(30) Foreign Application Priority Data

Jan. 14, 1999 (JP) ..... 11-007986

(51) Int. Cl.[7] ..... B63B 8/00
(52) U.S. Cl. ..... 114/363; 114/55.5
(58) Field of Search ..... 114/362, 363, 114/55.5, 55.57, 55.53, 343

(56) References Cited

U.S. PATENT DOCUMENTS 5,676,086 * 10/1997 Watkins ..... 114/55.51
5,857,423 * 1/1999 Imaeda et al. ..... 114/270

FOREIGN PATENT DOCUMENTS 234330 10/1926 (JP) .
4-221289 8/1992 (JP) .
5-24582 2/1993 (JP) .
5-178281 7/1993 (JP) .
2716942 7/1997 (JP) .
10-236387 9/1998 (JP) .

* cited by examiner

*Primary Examiner*—Ed Swinehart

(57) ABSTRACT

It is an object of the invention to provide a personal watercraft having a rear deck floor which can house goods necessary for water-skiing or the like and is provided with a space where a water-skier or the like sits when getting into the water or a space for embarkation when coming out of the water into a watercraft.

In a personal watercraft having a whole plane view almost shell-shaped comprising a riding seat S provided from an almost central portion of a body A of a watercraft to a rear portion thereof, a steering handlebar 21 provided in front of the riding seat S, an engine E for propulsion provided below the riding seat S, and a jet pump P provided behind the engine, the jet pump being provided with an outlet port rearward for being driven by the engine, a rear deck floor 1 having a space for at least one adult to sit is provided behind the riding seat S and has an openable hatch cover 1A formed on the space, and a rear storage box 1B is formed under the hatch cover 1A.

6 Claims, 7 Drawing Sheets

PERSONAL WATERCRAFT

BACKGROUND OF THE INVENTION

1. Field of the Invention

The invention relates to a rear deck floor for a personal watercraft (also called a PWC) that planes along the surface of the water.

2. Description of the Related Art

In recent years, personal watercraft have come into wide use for recreational purposes or sports.

Personal watercraft have recently been used for water-skiing or the like which has been conventionally performed using a leisure boat. For this reason, a storage box covered with an openable hatch cover has been conventionally provided as a storage means in a front portion of personal watercraft. In addition to the above-mentioned storage box, a storage box having a small capacity which can house very small articles such as gloves, sunglasses or the like has been provided between the riding seat and the steering handlebar arranged in front thereof.

However, in the case where the personal watercraft is used for water-skiing, for example, it is necessary to provide a storage box capable of housing a rope for pulling a water-skier and a flag which is used as a marker. Furthermore, it is also necessary to have a space where the water-skier sits when getting into the water or a space for embarkation when coming out of the water into a watercraft.

As prior art, Japanese Patent No. 2,716,942 has disclosed a structure which is effective in coming out of the water into a watercraft.

SUMMARY OF THE INVENTION

In consideration of such circumstances, it is an object of the invention to provide a personal watercraft having a rear deck floor which can store goods necessary for water-skiing and has a space where a water-skier sits when getting into the water or a space for embarkation when coming out of the water into a watercraft.

A first aspect of the invention is directed to a personal watercraft comprising a riding seat located in an almost central portion of a body of a watercraft to the rear portion thereof, a steering handle in front of the riding seat, an engine for propulsion below the riding seat, and a water jet pump behind the engine, the water jet pump being provided with an outlet port rearward and being driven by the engine, wherein a rear deck floor having a space for at least one adult to sit is provided behind the riding seat and has an openable hatch cover formed thereon, and a rear storage box is formed under the hatch cover.

According to the personal watercraft of the invention, the space formed behind the riding seat can be utilized for sitting when a skier gets into the water or for embarkation when he or she comes out of the water into the watercraft. A rear storage box provided in this space can storage a rope for pulling water skis, a flag and the like.

If most of the rear deck floor in the personal watercraft is flat, it is possible to have a structure which can easily be used by the water-skier.

If an upper edge of the rear storage box is formed integrally with a floor face on a periphery thereof and a bottom face of the rear storage box is attached integrally with a bulkhead of a pump chamber, for housing the water jet pump, provided thereunder in the personal watercraft, the structure can have high rigidity and the stern portion of the personal watercraft can have high rigidity even if a larger space than in the prior art is formed behind the riding seat and most of the space is constituted by a flat area.

If a handgrip is formed on both side ends of the rear deck floor in the personal watercraft, the skier can hold the handgrip when getting into the water or coming out of the water into the watercraft Consequently, it is easy for the skier to get in and out of the water. When goods are to be loaded into the space, the rope for holding the goods can be bound to the handgrip. Moreover, when the personal watercraft is to be moored at a pier or the like, the handgrip may be utilized.

Furthermore, if the handgrip forms a streamline shape integral with a deck fin which is streamlined on both boards of the personal watercraft, the shape of the watercraft will have a nice appearance.

DETAILED DESCRIPTION OF THE PREFERRED EMBODIMENT

A personal watercraft according to an embodiment of the invention will be described more specifically with reference to the drawings.

Figure 1:
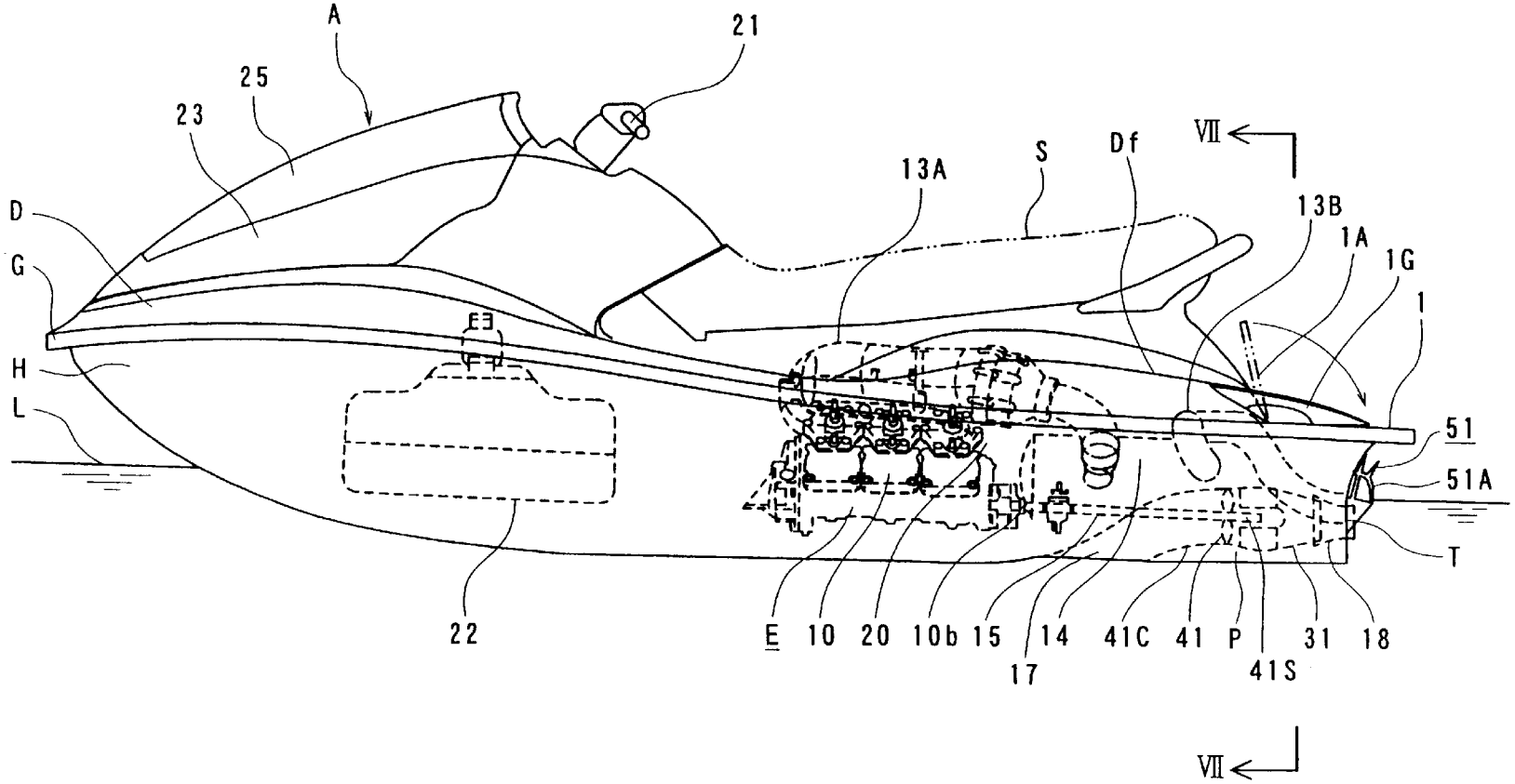
FIG. 1 is a side view showing a personal watercraft provided with a rear deck floor according to an embodiment of the invention.
Figure 2:
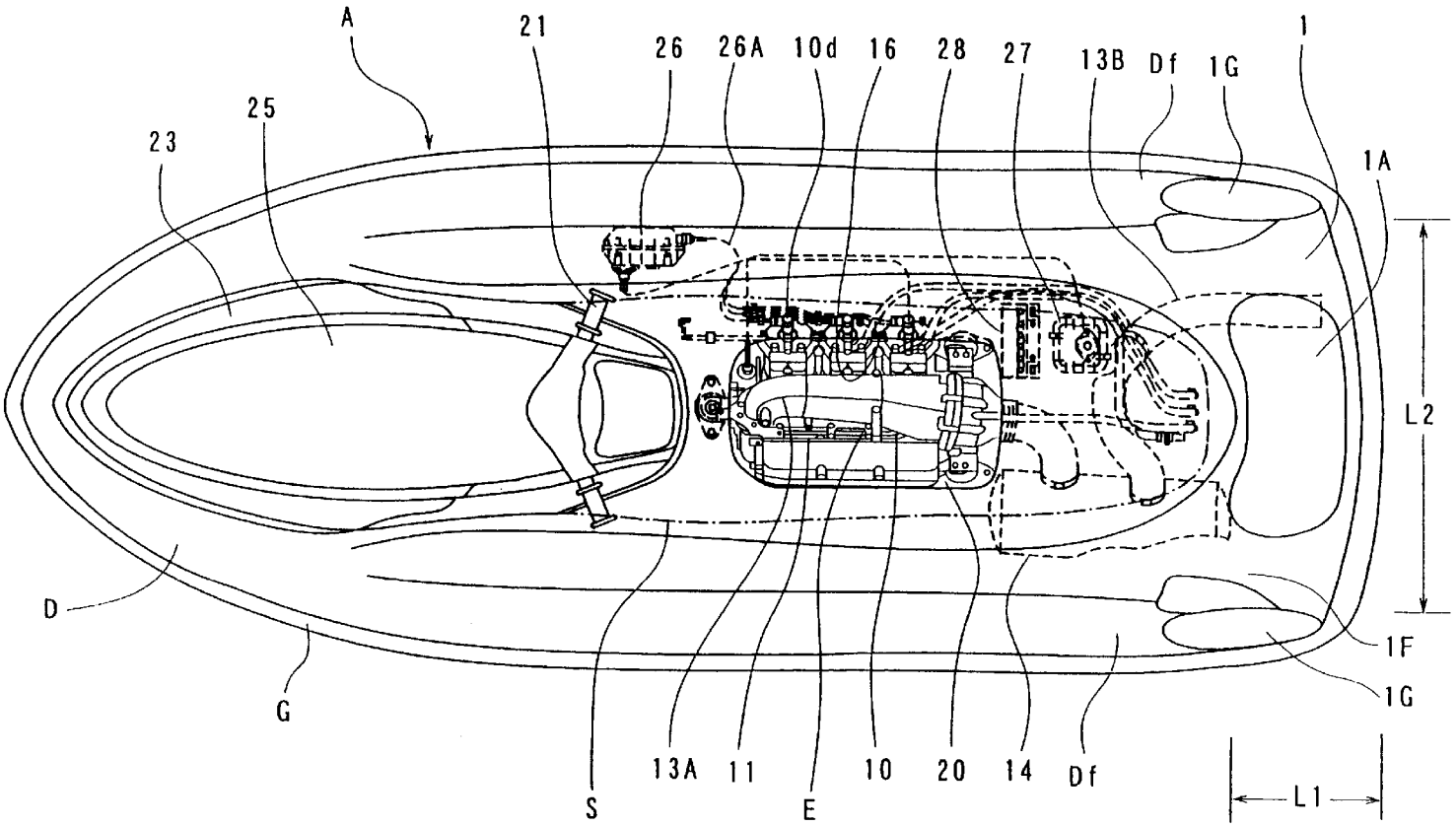
FIG. 2 is a plan view with removing a seat for showing the personal watercraft of FIG. 1.

In FIGS. 1 and 2, A denotes a body of a personal watercraft. The body A comprises a hull H and a deck D covering an upper portion of the hull H. A line for connecting the hull H and the deck D over the entire periphery is referred to as a gunnel line G. In the illustrated embodiment, the gunnel line G is positioned above a waterline L of the personal watercraft.

An opening 16 having a top face almost rectangular in shape as seen in a plan view along the longitudinal direction of the body A is formed slightly behind the center of the deck D as shown in FIG. 2. As shown in FIGS. 1 and 2, a riding seat S is provided above the opening 16. The seat S has such a length as to correspond to the distance between a central portion of the personal watercraft and a rear portion thereof. Accordingly, the rear end of the seat S is extended further away from the opening 16.

An engine E is provided in a space (referred to as an "engine space") 20 which is surrounded by the hull H and deck D provided under the seat S and has a "convex" cross-sectional shape.

The engine E has multiple cylinders (3 cylinders in the embodiment). As shown in FIG. 1, a crankshaft 10*b* of the engine E is mounted in the longitudinal direction of the body A. As shown in FIG. 2, a carburetor 11 and an air intake chamber (not shown) connected thereto are provided on the left side of an engine block 10 (on the left board of the personal watercraft). As shown in FIGS. 1 and 2, an exhaust pipe 13A is provided above the engine block 10. The exhaust pipe 13A is connected to a water muffler (silencer) 14 provided obliquely in the left side and rear side portion of the engine block 10. An exhaust pipe 13B having a terminal reached the outside of the rear end of the body A from the water muffler 14 is provided above a water jet pump P(see FIG. 1).

As shown in FIG. 1, an output end of the crankshaft 10*b* which protrudes rearward from the engine block 10 is rotatably coupled integrally with the tip side of an impeller 41 of the water jet pump P through a propeller shaft 15. The rear end side of the impeller 41 is rotatably coupled integrally with a pump shaft 41S of the water jet pump P. The impeller 41 is covered with a pump casing 41C on the outer periphery thereof. The water pump P sucks water from a water intake (water feeding port) 17 provided on the bottom of hull through a water intake passage, and pressurizes and accelerates the water. The pressurized and accelerated water is ejected from an outlet port provided on the rear end of an pump nozzle 31 having a cross-sectional area of flow gradually reduced rearward, thereby obtaining propulsive force.

In FIGS. 1 and 2, the reference numeral 21 denotes a steering handlebar. By operating the handlebar 21 right and left, the steering nozzle 18 provided behind the pump nozzle 31 can be swung from side to side, so that the watercraft may be steered in the desired direction.

A deflector 51A of a reverser 51 (see FIG. 1) is attached to the body A through a fixing member (not shown) in an upper rear portion of the steering nozzle 18 such that it can be swung downward around a pivot shaft which is provided horizontally but is not shown. By operating the deflector operation lever provided in the vicinity of the seat which is not shown, the deflector 51A is swung into a position behind the steering nozzle 18. Consequently, the water flow ejected rearward from the steering nozzle 18 is turned laterally to form a lower pressured water area in a rear portion of a transom T of the body A than on the periphery. Thus, the watercraft can move backward. When the deflector 51A is swung upward (raised) around the pivot (not shown) in the reverser 51 according to the embodiment, it is positioned on the surface of the water as shown by a solid line in FIG. 1. When the deflector 51A is swung downward (lowered), it is positioned behind the steering nozzle 18, which is not shown.

In FIG. 1, the reference numeral 22 denotes a fuel tank for supplying fuel to the engine E, and the reference numeral 23 denotes a front hatch cover. A front storage box (not shown) for housing equipment or the like is provided under the hatch cover 23. Another hatch cover 25 is provided on the front hatch cover 23. Thus, a double hatch cover is formed. Equipment or the like can be housed inside the hatch cover 25 through an opening (not shown) provided on a rear end face of the hatch cover 25.

In FIG. 2, the reference numeral 26 denotes an ignition device for supplying electricity to an ignition plug 10*d* through cord 26A with proper timing, the reference numeral 27 denotes a oil tank, and the reference numeral 28 denotes a battery.

The rear deck floor according to the embodiment of the invention has the following structure.

In FIGS. 1 and 2, the reference numeral 1 denotes a rear deck floor. The rear deck floor 1 is positioned adjacent to the rear portion of the seat S, and is provided with an openable hatch cover 1A. A rear storage box 1B having a small capacity (a volume of about 10 to 15 liters) which is shown in FIG. 5 is provided under the hatch cover 1A.

Figure 5:
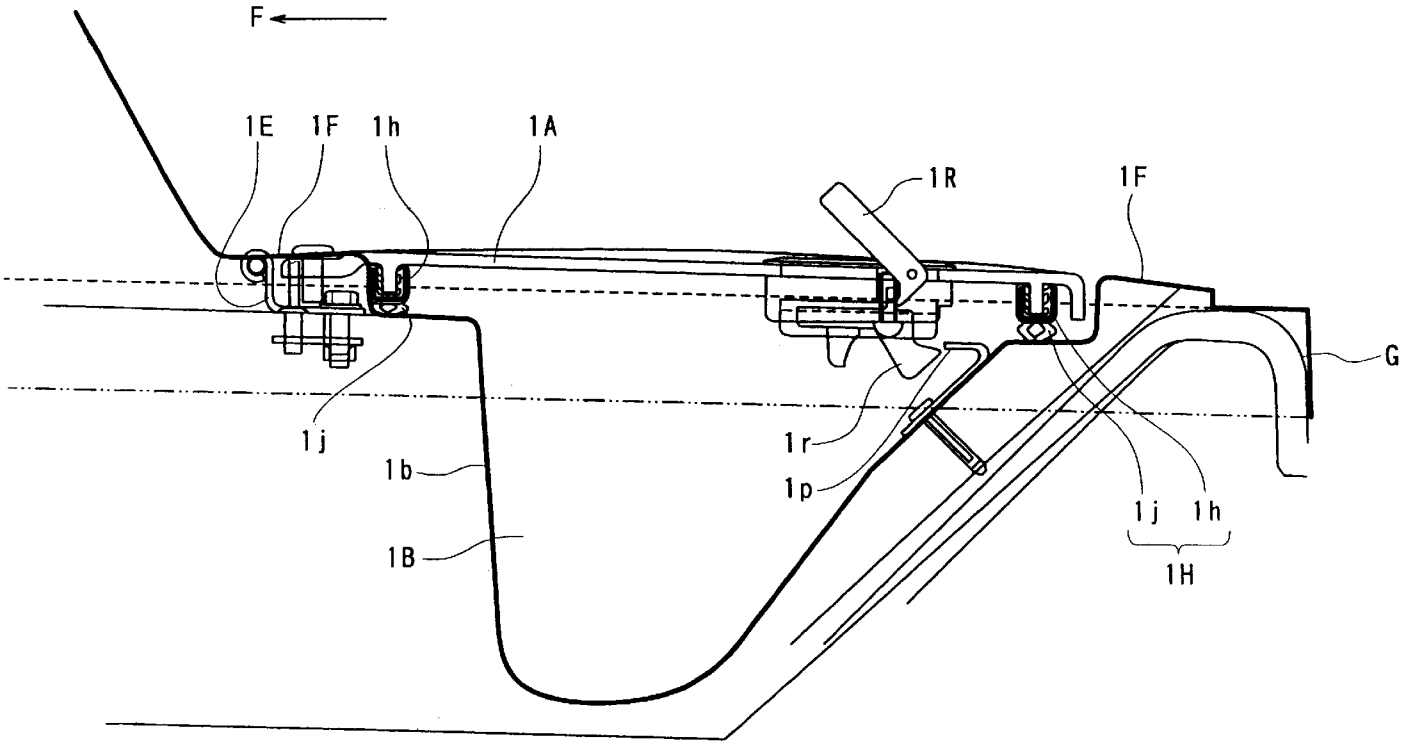
FIG. 5 is a sectional view taken along the line V—V in FIG. 7, briefly illustrating the structure of the rear storage box.

In FIG. 5, the reference arrow F shows the direction of the stern.

Figure 7:
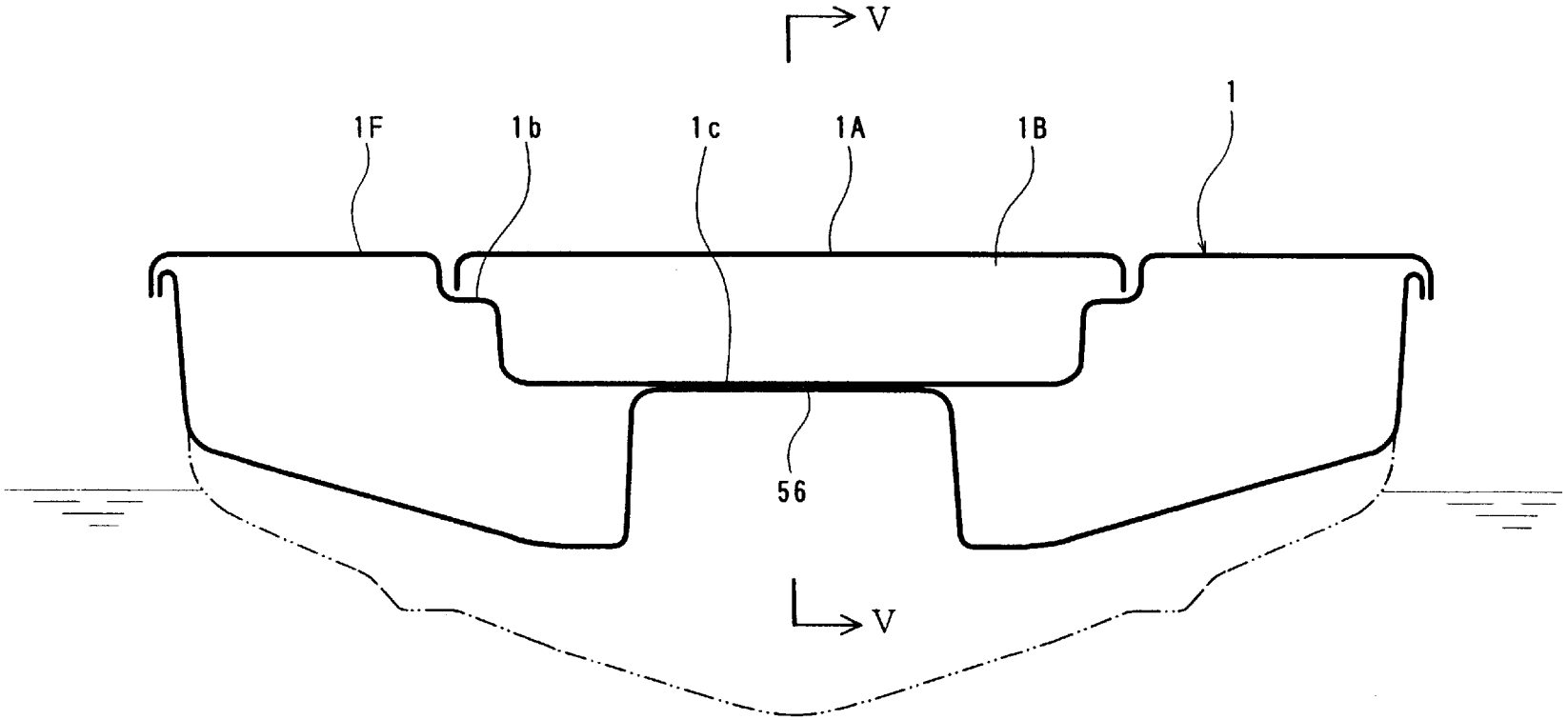
FIG. 7 is a sectional view taken along the line VII—VII of FIG. 1, illustrating the schematic structures of the rear storage box and a hatch cover portion.

As shown in FIGS. 5 and 7, a wall portion 1*b* of the rear storage box 1B has an upper edge formed of resin integrally with the surrounding face of the floor 1F. As shown in FIG. 7, a part (central part) of a bottom face 1*c* of the wall portion 1*b* of the rear storage box 1B is attached integrally with a bulkhead 56 of a pump chamber (the space for housing a jet pump) provided thereunder with a bolt or an adhesive. For this reason, although the rear deck floor 1 provided behind the seat S is extended more rearward in the embodiment than in the conventional watercraft, the rigidity of the whole stem is enhanced.

Figure 6:
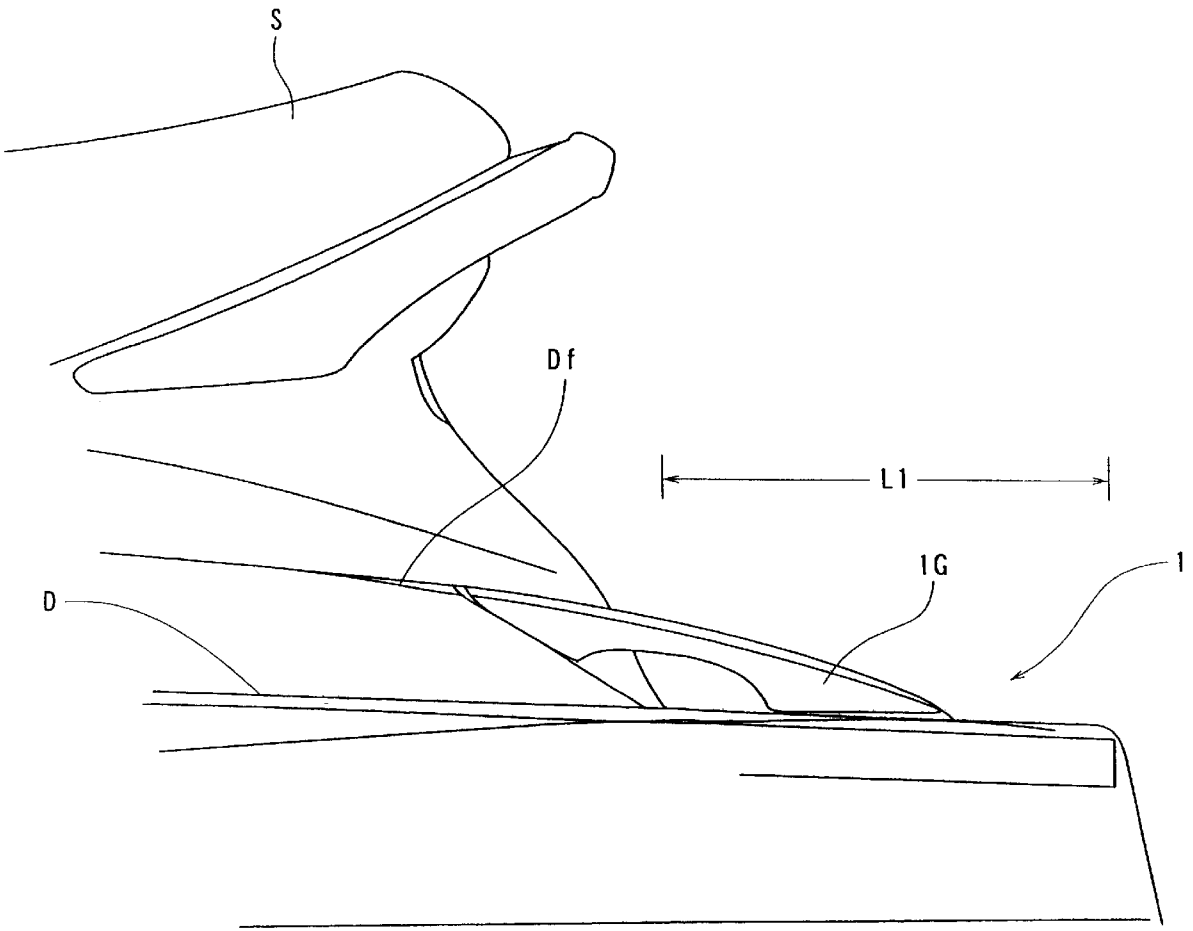
FIG. 6 is an enlarged side view of a stern portion of the personal watercraft in FIGS. 1 and 2, illustrating the configuration of the side of the main parts of the invention.

As shown in FIGS. 1 to 4, there is enough area (space) for an adult to sit on the rear deck floor 1. More specifically, the narrowest portion forms a plane having a longitudinal dimension L1 of 35 cm (see FIGS. 2 and 6) and a lateral dimension L2 of 90 cm (see FIG. 2) in the embodiment.

Figure 4:
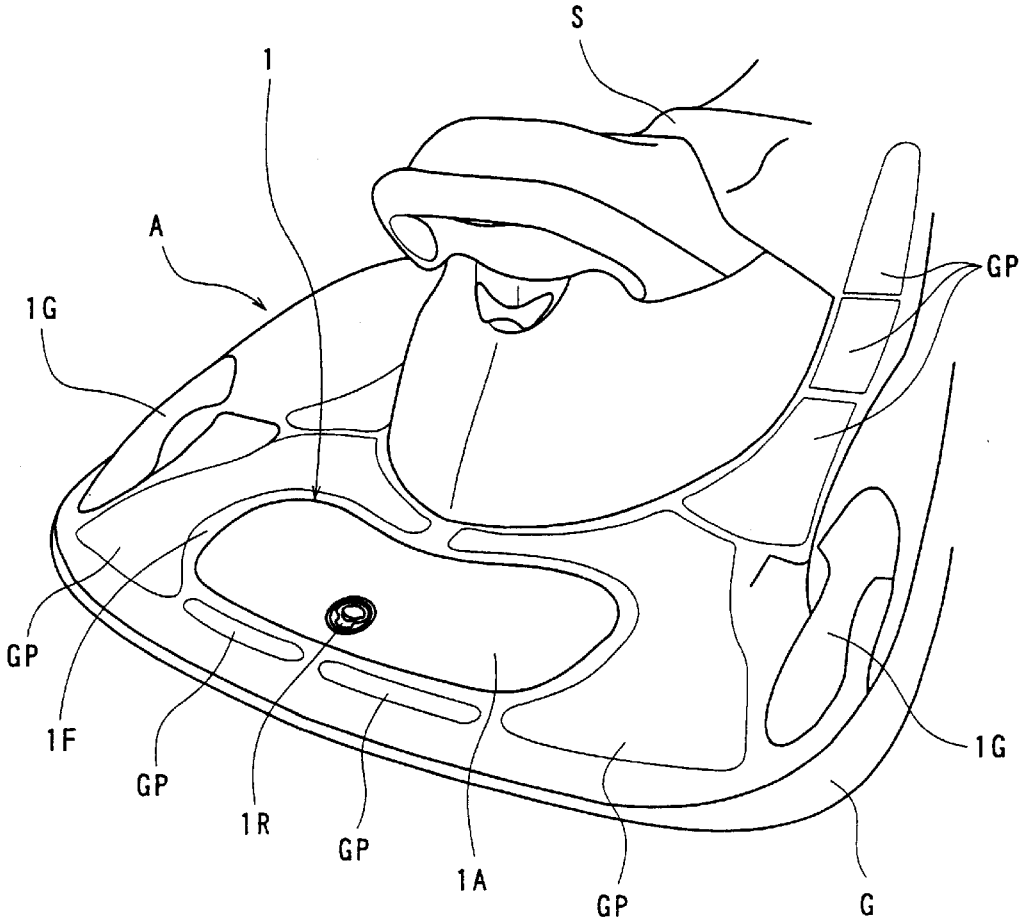
FIG. 4 is a perspective view seen from an obliquely rear side of the personal watercraft in FIGS. 1 and 2, illustrating the appearance of main parts of the embodiment.

A handgrip 1G shown in FIGS. 1, 4 and the like is provided on both side ends of the rear deck floor 1. The handgrip 1G recedes from the rear end of the watercraft by about 15 cm in the longitudinal direction so that a person may sit on the rear deck floor 1 with legs down over the stem and with both hands down. As shown in side views of FIGS. 1 and 6 and schematic plan views of FIGS. 2 and 4, the handgrip 1G forms a streamline shape integral with a deck fin Df which is streamlined on both sides of the personal watercraft.

In the embodiment, fixing bolts which are not shown are projected from a lower portion of the handgrip 1G. The handgrip 1G is fixed to the deck D of the personal watercraft with the bolts.

As shown in FIG. 5, a seal member 1H is provided between the hatch cover 1A and the rear storage box 1B provided thereunder. The seal member 1H includes a seal 1*h* having a U-shaped cross section which is on the hatch cover 1A side, and a seal 1*j* having a diamond-shaped cross section on the rear storage box 1B side to be joined to the seal 1*h*.

Figure 3:
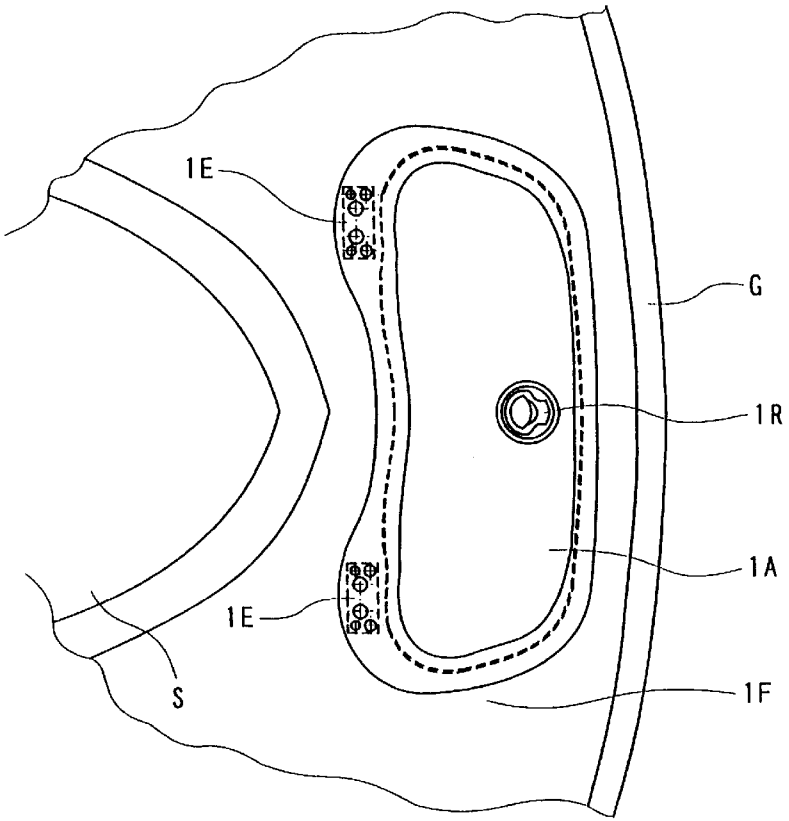
FIG. 3 is a partially enlarged view showing the planar configuration of the rear deck floor of the personal watercraft in FIGS. 1 and 2.

The hatch cover 1A has the following structure: A pair of right and left hinge members 1E are provided on the stem side as shown in FIG. 3, and an opening and closing fixture (lock fixture) 1R is provided on the stern side. As shown in FIG. 5, one of the ends of the opening and closing fixture 1R (the stem end side in the embodiment) is raised upward so that an engagement fixture 1*r* is disengaged from an engagement fixture 1*p*. Consequently, the hatch cover 1A can be opened around the rotational center of the hinge member 1E as shown in FIG. 1.

In a personal watercraft having such a structure, ropes for water-skiing or flags for marking can be stored in the rear storage box 1B. Alternatively, gloves, a light, goggles and the like can be stored.

When water-skiing, a skier can let his or her hips down to the rear deck floor 1 with his or her legs hanging from the stern end into the water, and can hold the handgrip 1G with his or her hands to easily go into the water.

When the skier comes out of the water onto the rear deck floor 1 of the personal watercraft, he or she holds the handgrip 1G with his or her hands and goes down steps which are provided on the stem but are not shown (a ladder for embarkation from the water into the watercraft). Thus, the skier can readily get onto the rear deck floor 1.

Goods and the like can also be loaded onto the rear deck floor 1. In such a case, a hook of a rope, a hook of a holding net or the like is hooked to the handgrip 1G -so that the goods are fixed to the rear deck floor 1 of the watercraft.

As shown in FIG. 4, a rubber pad GP can be stuck on the rear deck floor 1.

While the rear storage box 1B has been formed integrally with the deck of the personal watercraft in the above embodiment, they can also be separately formed and fixed integrally by fixing means such as a bolt.

What is claimed is:

1. A personal watercraft having a single riding seat located from an almost central portion of a body of the watercraft to a rear portion thereof and which can accommodate only one to three riders sitting straddle fashion, a steering handle provided in front of the riding seat, an engine for propulsion provided below the riding seat, and a water jet pump provided behind the engine, the water jet pump being provided with a rearward outlet port and being driven by the engine, further comprising:

a rear deck floors, having a floor face and space for at least one adult to sit, is provided behind said riding seat;

an openable hatch cover formed thereon; and a rear storage box is provided under the hatch cover.

2. The personal watercraft according to claim 1, wherein most of the face of the rear deck floor is flat.

3. The personal watercraft according to claim 1, wherein an upper edge of the rear storage box is formed integrally with the floor face on the periphery thereof, and a bottom face of the rear storage box is attached integrally with a bulkhead of a pump chamber for housing the water jet pump.

4. The personal watercraft according to claim 1, wherein a handgrip is formed on both side ends of the watercraft adjacent said rear deck floor in a manner to be grasped by a person seated upon said floor.

5. The personal watercraft according to claim 4, wherein the handgrip forms a streamline shape integral with a deck fin which is streamlined on both sides of the personal watercraft adjacent said deck floor.

6. The personal watercraft according to claim 5 wherein each handgrip is constituted by apertures laterally formed in portions on both sides of the rear deck which protrude upwardly from said face of the rear deck so that a person seated on the rear deck can grasp the handgrips with both hands.

* * * * *